US005996259A

United States Patent [19]

Gallay et al.

[11] Patent Number: 5,996,259

[45] Date of Patent: Dec. 7, 1999

[54] SNOWSHOE FOR USE ON A RANGE OF TERRAINS AND SNOW CONDITIONS

[75] Inventors: Philippe Gallay, La Clusaz; Christophe Burnet, Saint Martin de Bellevue, both of France

[73] Assignee: Techniques Sports Loisirs, Alex, France

[21] Appl. No.: 09/238,988

[22] Filed: Jan. 28, 1999

[30] Foreign Application Priority Data

Jan. 29, 1998 [FR] France ..... 98 01263

[51] Int. Cl.[6] ..... A43B 5/04

[52] U.S. Cl. ..... 36/122; 36/124

[58] Field of Search ..... 36/122, 123, 124, 36/125

[56] References Cited

U.S. PATENT DOCUMENTS 3,638,333 2/1972 Sprandel ..... 36/125
5,682,688 11/1997 Gallay ..... 36/122
5,813,147 9/1998 Burnet et al. ..... 36/122
5,881,477 3/1999 Watson ..... 36/122

FOREIGN PATENT DOCUMENTS 2731360 9/1996 France .

*Primary Examiner*—M. D. Patterson
*Attorney, Agent, or Firm*—Fay, Sharpe, Fagan, Minnich & McKee, LLP

[57] ABSTRACT

A snowshoe (1) has a peripheral frame (2). A deck (4) extends across an interior of the peripheral frame and supports a binding (5) for retaining the boot of the user. The snowshoe has horizontal surfaces for supporting the snowshoe and the user on top of the snow and downward depending on traction members (3*a*, 3*b*, 50*a*, 50*b*) for engaging the snow to facilitate walking without slipping. The traction members are preferably disposed vertically and extend downward below a horizontal plane (H) of the deck. The traction members have regions of reduced height (100, 100*a*, 100*b*, 100*c*, 100*d*, 100*e*, 100*f*) relative to a forward portion (7*a*) of the traction members or the rearward portion (7*c*) of the traction members in a central zone (B) aligned with the region which receives and holds the user's boot (6).

14 Claims, 9 Drawing Sheets

SNOWSHOE FOR USE ON A RANGE OF TERRAINS AND SNOW CONDITIONS

BACKGROUND OF THE INVENTION

The present invention relates to snowshoes. It is particularly directed to a snowshoe with notably improved ease in walking in the snowshoes, as well as reduced slipping over a wide variety of types of snow.

Snowshoes are a mode of transportation that has been known for many years. They have been used for several centuries by Scandinavian populations for mobility in snow. Previously, snowshoes have been used for utilitarian or military purposes to permit civilians or alpine troops to travel on snow for the activities necessitated by daily life. Currently, snowshoes are more commonly used by athletes for outings and hiking and even for competition. But, athletes, even who practice for pleasure, are more and more exacting about the equipment that they use. It is true that the currently sold products are not completely satisfactory.

Also, the snowshoes must combine the criteria of traction and floatation all while preserving maximum comfort for their users. Besides, depending on which of various types of snow is encountered, the floatation, traction, and other characteristics of the snowshoe needed for an agreeable outing can prove different. Likewise, according to which of the various terrains are encountered, the general form of the snowshoe best adapted to it can be equally different. Accordingly, each snowshoe is generally configured for selected snow conditions and terrain conditions and often performs less well under other conditions.

The requirement of traction is a major criteria for snow shoes. The snowshoes of the prior art have shortcomings. On certain types of snow, they fail to grip, notably in the longitudinal and traverse directions.

The present application seeks to remedy these shortcomings, simply, inexpensively, and effectively. One open object of the present snowshoes is to improve traction on one and all kinds of snow and to increase the ease of walking for the user.

According to a principle characteristic, the present snowshoes include a peripheral frame surrounding an interior deck or lacings on which a binding is disposed for retaining the boot of the user. The snowshoe is provided with longitudinal traction members depending vertically below a horizontal plane of the deck. It is characterized in that a portion of at least one of the longitudinal traction members is reduced in height in a central zone situated longitudinally to the region occupied by the boot of the user. The height is reduced in comparison to the portion before and the portion after the aforesaid central zone.

According to another characteristic of the snowshoe, it includes two longitudinal traction members disposed laterally and forming the peripheral frame. That is, the lateral edges of the frame each shrink in height in the central zone, respectively.

According to a complementary characteristic, the reduced height of the lateral edges of the peripheral frame are disposed symmetrically in comparison to a central, longitudinal plane of the snowshoe.

Then again, according to a preferred embodiment of the present snowshoe, it includes at least one longitudinal traction member depending from the deck inward from the edge of the peripheral frame. The interior traction member has a least one reduced height region in its central zone.

According to a preferred embodiment of the snowshoe, each interior traction member is symmetric relative to the central longitudinal plane and has two regions of reduced height separated by a region of enlarged or full height.

According to one complementary characteristic of the present snowshoe, the reduced height portions of the interior longitudinal traction members are offset longitudinally relative to the position of the reduced height portions of the lateral frame traction members.

According to an alternate embodiment of the present snowshoe, the position of the enlarged height portions of the interior traction members is offset longitudinally toward the front of the snowshoe relative to the reduced height portions of the lateral traction members.

According to a complementary characteristic of the present snowshoe, the reduction in height is attained in a varying manor longitudinally relative to a horizontal plane of the deck. The lower edge surface of the longitudinal traction members varies along linear slopes and/or curved segments.

According to another characteristic of the present snowshoe, a ratio between the height of the reduced height portion and a maximum height of the traction member, measured to the front or the rear is between 0.1 and 0.9.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENT

Figure 1:
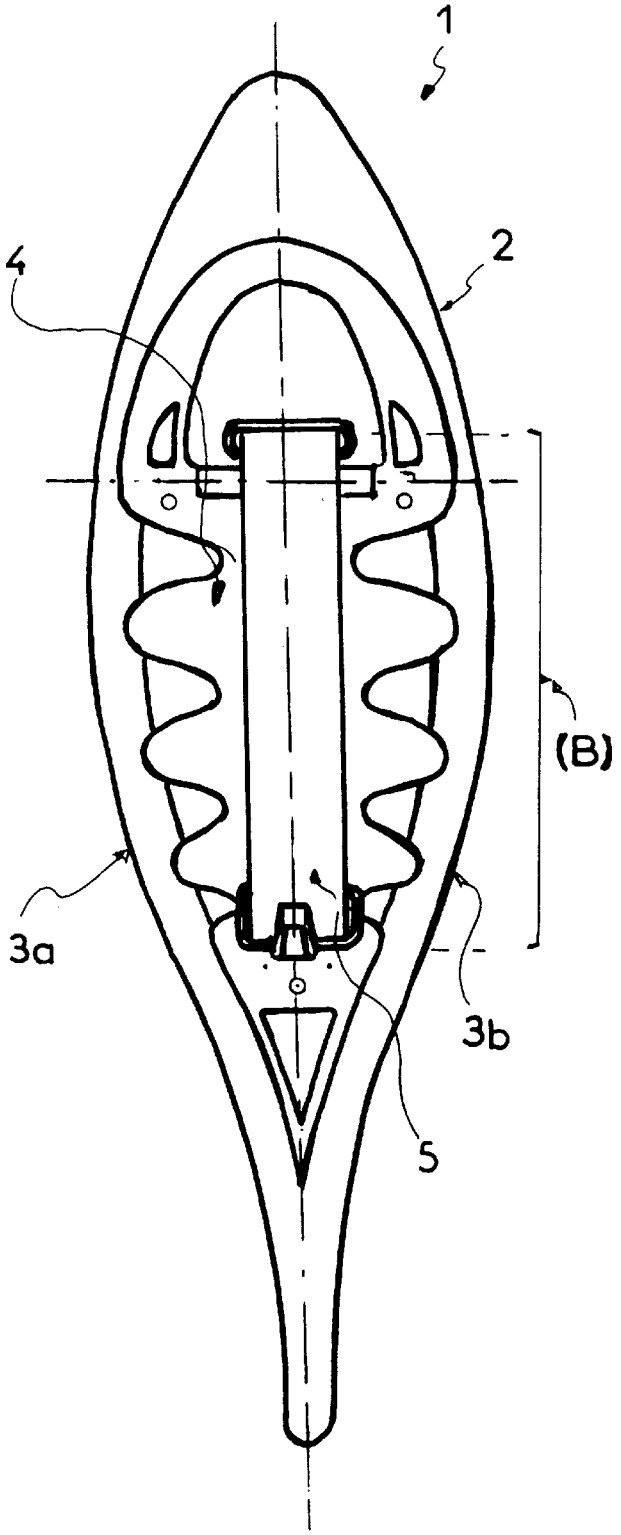
FIG. 1 is a top view of a snowshoe in accordance with the present invention.
Figure 2:
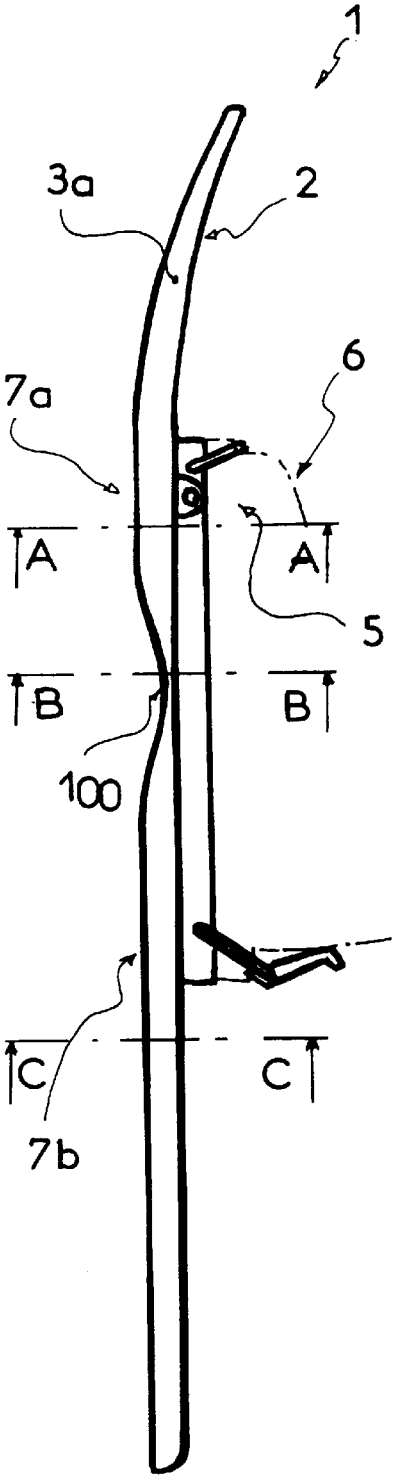
FIG. 2 is a side view of a first embodiment of the snowshoe of the present invention.
Figure 3A:
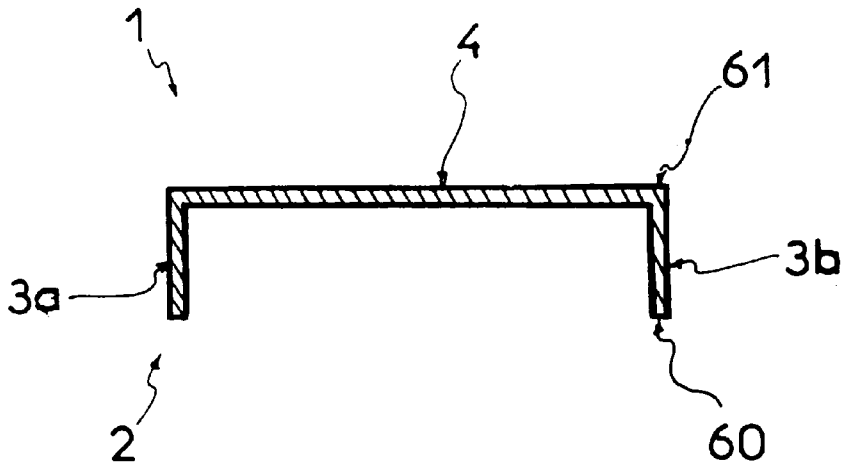
FIGS. 3*a*, 3*b*, 3*c* represent cross-sections of the first embodiment of the frame and the deck of the snowshoe along section lines A—A, B—B, and C—C, respectively.
Figure 3B:
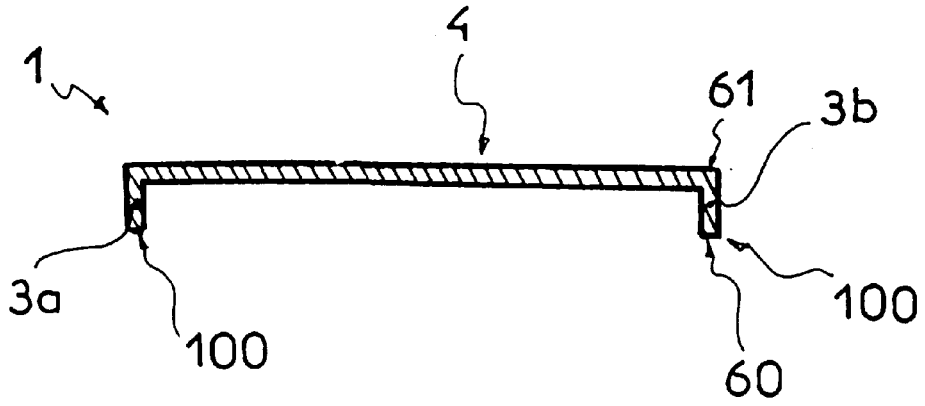
Figure 3C:
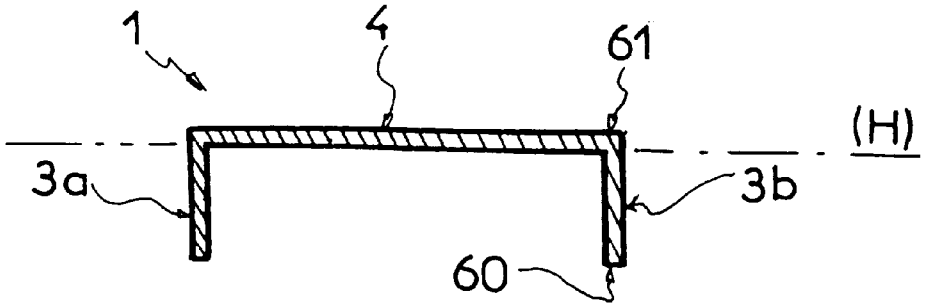
Figure 4:
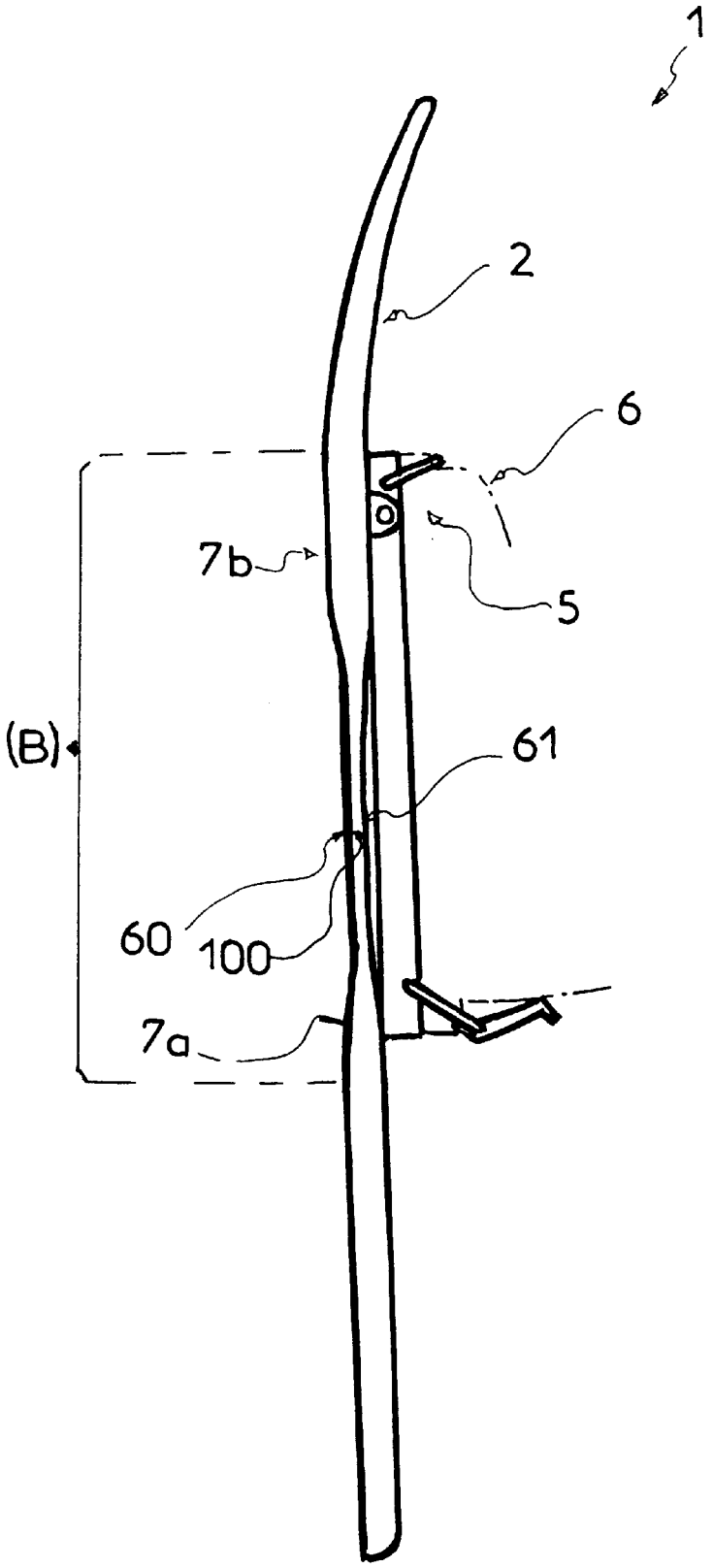
FIG. 4 is a side view of a first alternate embodiment of the present snowshoe.

A snowshoe 1 includes a peripheral frame 2 which surrounds a deck 4 which supports a binding 5 in which the boot 6 of the user is retained. The deck 4 is made up advantageously, by a flexible sheet, for example, but could equally well be a web or lacings which are designed to confer the flotation necessary for the snow shoe 1.

The present snowshoe includes a group of longitudinal traction members or walls 3*a*, 3*b*, 50*a*, 50*b* which extend downward, preferably vertically from a horizontal plane H of the deck 4. These traction members are able, for example, to constitute the lateral edges lips, or flanges 3*a*, 3*b* of the peripheral frame as illustrated in FIGS. 1–7 or to be disposed interior of the frame on the deck 4 to form the interior longitudinal traction members or cleats 50*a*, 50*b* as is shown in the preferred embodiment illustrated in FIGS. 8–10*d*. According to the invention, at least one of the longitudinal traction members 3*a*, 3*b*, 50*a*, 50*b* has, in the central zone or region B of the snowshoe, a recession in height 100 vertically as compared to the part before 7*a* and to the part behind 7*b* central region. The central zone region extends longitudinally at the level of the region occupied by the boot 6 of the user.

In the first preferred embodiment of the snowshoe, there is a longitudinal plane of general symmetry P on either side of which lies two traction members which form the lateral edges 3*a*, 3*b* of the peripheral frame 2 as shown in FIGS. 1–3*c*. The lateral traction members 3*a*, 3*b* each have a reduction in height 100 in their central zone B. These reduced height regions are identical and are disposed symmetrically relative to the longitudinal plane of symmetry P. It is readily seen that the reductions in height could be disposed in different locations and could have, for example, a non-symmetric form without departing from the scope of the present invention.

The reductions in height 100 are advantageously defined by variations in inclination and/or curvature of a lower edge surface 60 of the longitudinal traction members 3*a*, 3*b*, 50*a*, 50*b* relative to the horizontal plane H. The upper edge surface 61 is parallel to the deck plane or recessed from it. It is apparent that in the alternate embodiment shown in FIG. 4, that the upper edge 61 can lay equally well along a linear incline or a curve relative to the horizontal plane H without departing from the scope of the present invention. The upper edge can be curved in the same manner as the lower edge but with less amplitude and oriented in an inverse manner. In this way, with the orientation of the selected curvature, the desired reduction in height is obtained.

Figure 7:
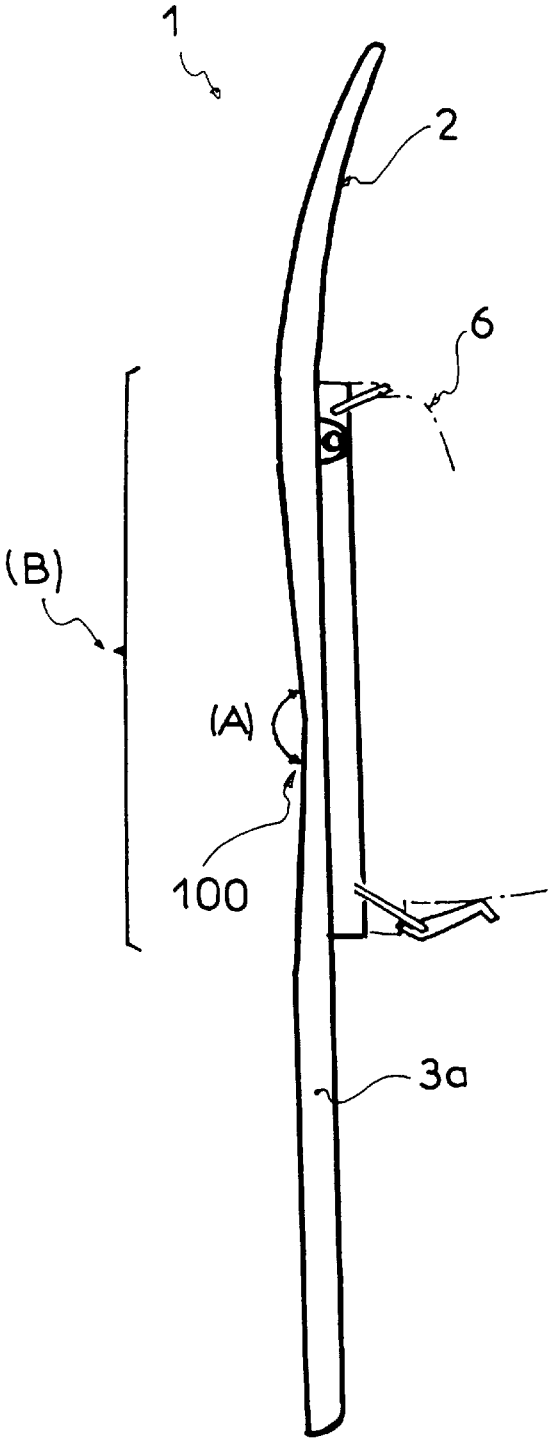
FIG. 7 is a side view of another alternate embodiment of the present snowshoe.
Figure 8:
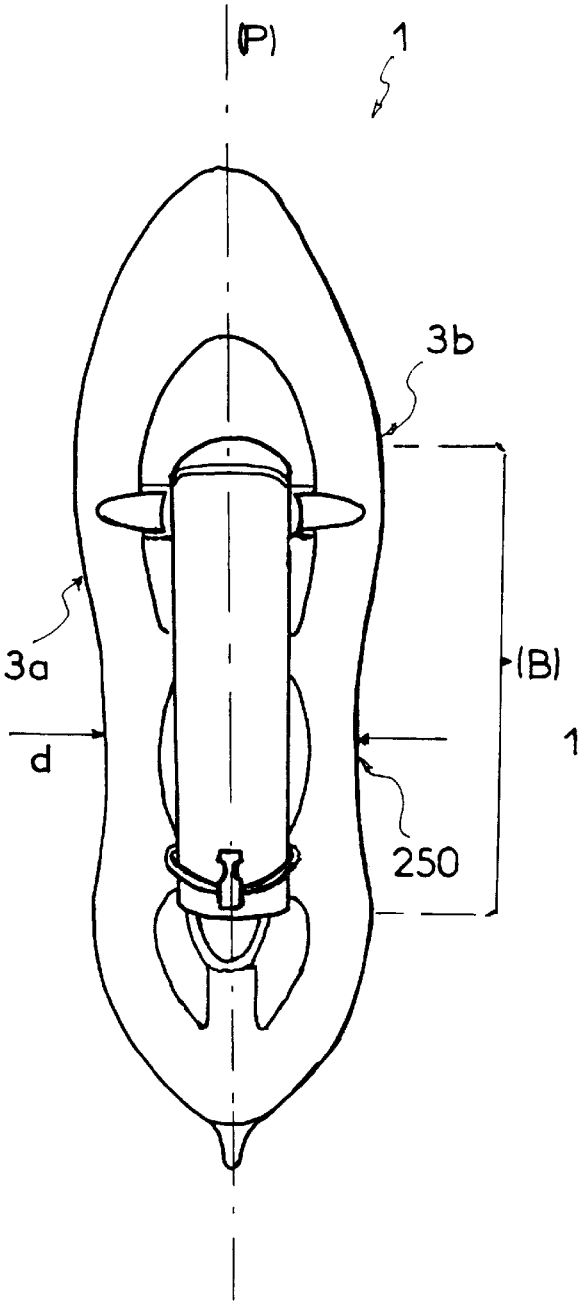
FIG. 8 is a top view of another preferred embodiment of the present snowshoe.
Figure 9:
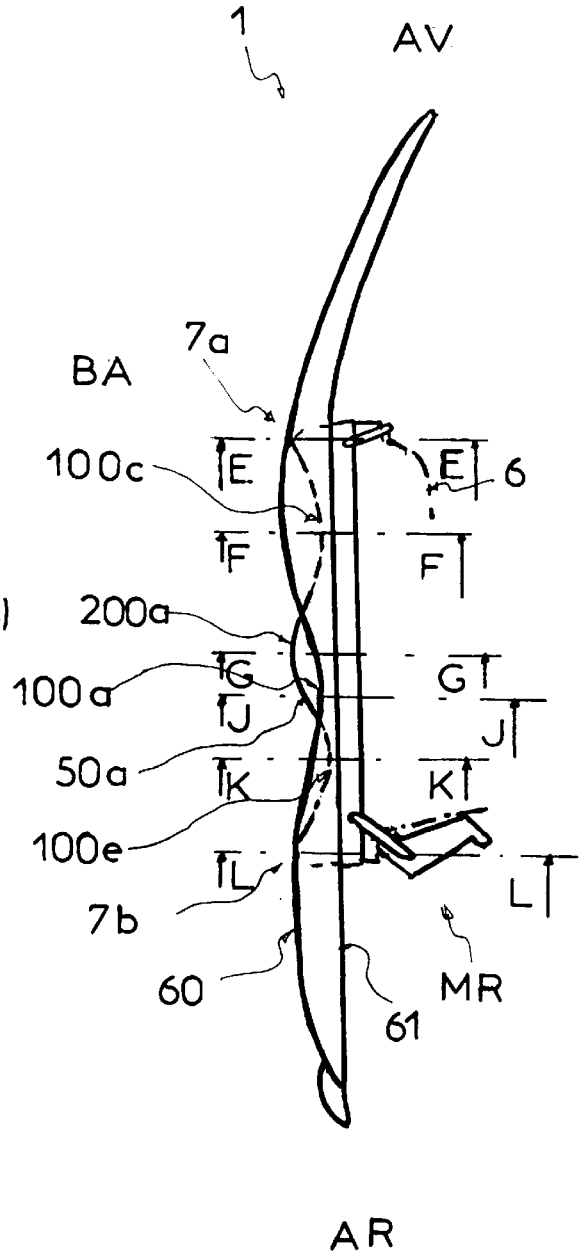
FIG. 9 is a side view of the snowshoe of FIG. 8.

In the first preferred embodiment of the snowshoe, the reduced height portions 100 of the lateral walls 3*a*, 3*b* of the framework 2 this advantageously situated in the central portion of the central zone B, i.e. the region adjacent the user's. Nonetheless, it can, for example, be located toward the front or the rear of this zone without departing from the scope of the present invention. Furthermore, the height reductions advantageously present a curved form on one of the two edge surfaces 60, 61 of the traction members 3*a*, 3*b*. The height reduction 100 can equally well vary linearly, as illustrated in FIG. 7, to obtain two linear lower edges that are inclined to form an angle A opening downward between them.

Figure 5A:
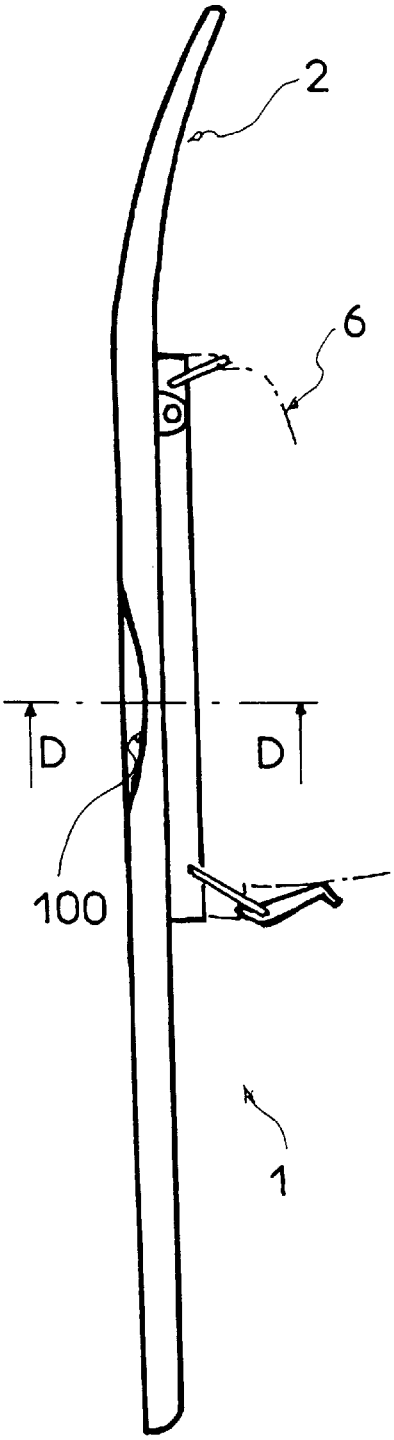
FIG. 5*a* is a side view of a second alternate embodiment.
Figure 5B:
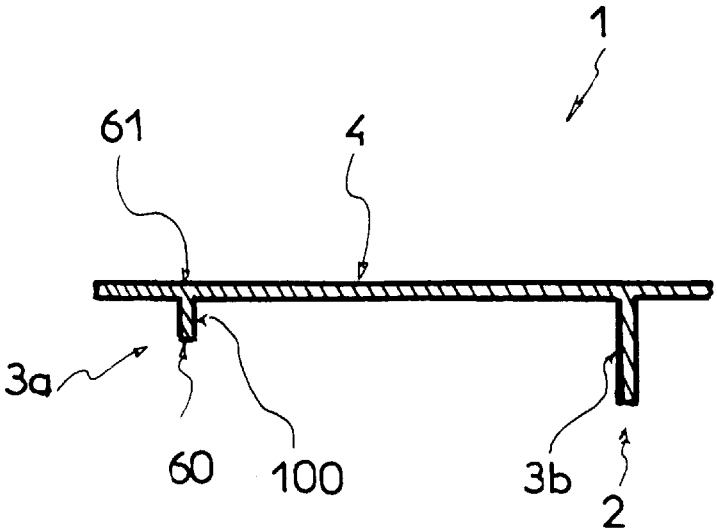
FIG. 5*b* is a transverse section through section D—D of FIG. 5*a;*
Figure 6:
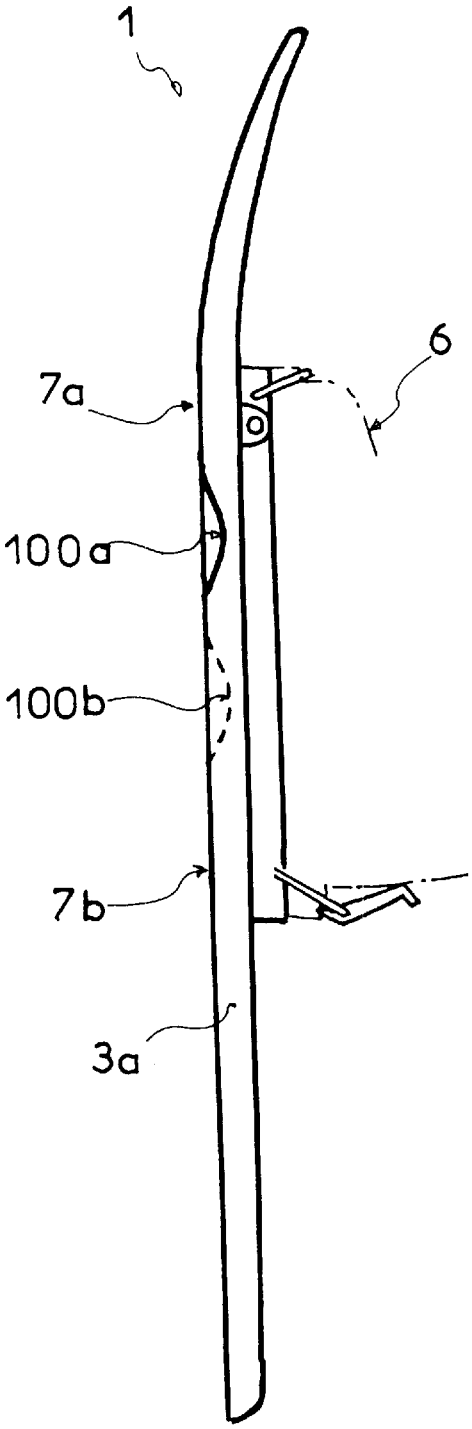
FIG. 6 is a side view of a second preferred embodiment of the present snowshoe.

According to an alternate embodiment of the snowshoe, the snowshoe 1 has a reduced height region 100*a*, 100*b* in each of the lateral edges 3*a*, 3*b* which reduced height regions are positioned longitudinally non-symmetrically relative to the plane P, as is shown in FIG. 6. Note that in the alternate embodiment, the two snowshoes of the same pair can be identical and have the reduced height region in the right lateral frame traction member forward of the height reduction in the left lateral frame traction member, for example. Alternately, it could be otherwise. The reductions in height can be on opposite sides, one snowshoe being specifically for the left foot and the other specifically for the right foot. In this embodiment, a means of identification is contemplated to permit differentiation. It is apparent that these snowshoes could possess an asymmetric profile, for example, as shown in FIGS. 5*a* and 5*b*, the snowshoe can have a reduction in height 100 in only one of the lateral edges 3*a* of the frame. Alternately, the deck 4 can extend laterally beyond the lateral edges 3*a*, 3*b* of the frame 2 such that the deck 4 overhangs. It is to be appreciated that the deck 4 can overhang the side walls 3*a*, 3*b* even in the other embodiments of the present snowshoe.

According to a preferred embodiment illustrated in FIGS. 8–10*f*, the longitudinal traction members 50*a*, 50*b* extend below the deck 4, preferably vertically. The interior traction members 50*a*, 50*b* are preferably two in number and are disposed on either side of the plane of general symmetry P aligned with the lateral edges of the boot 6 of the user and more preferably aligned with the edges of the support plate 63 which is intended to support the binding MR for the boot 6 of the user.

In this embodiment, the lateral traction members 3*a*, 3*b* that form the edges of the frame 2 as well as the two downward depending interior traction members 50*a*, 50*b* each have a region of reduced height 100*a*, 100*b*, 100*c*, 100*d*, 100*e*, 100*f*. The lateral edges 3*a*, 3*b* have symmetric height reductions 100*a*, 100*b* situated longitudinally in the center of the central zone B, as shown in FIGS. 9*a*, 10*a–f*.

Figure 10A:
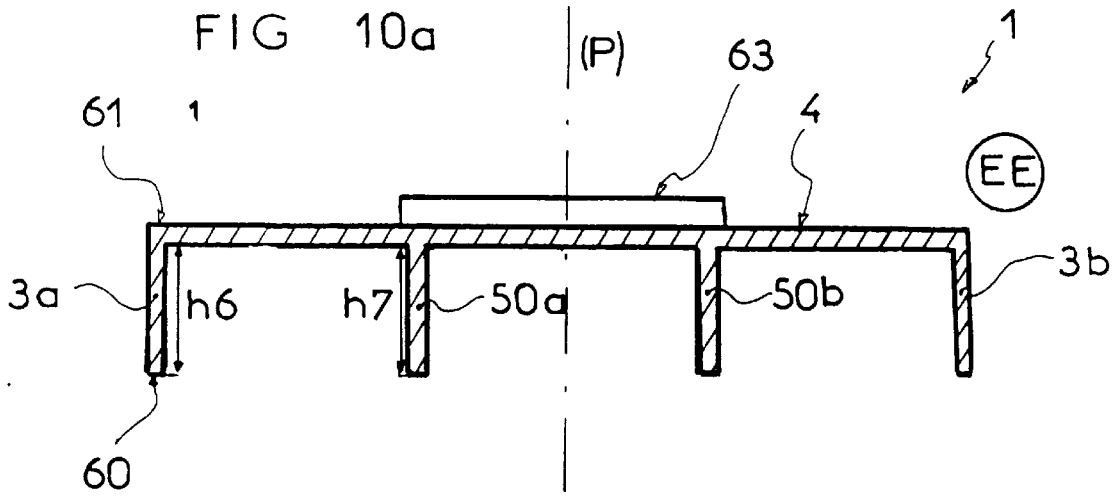
FIGS. 10*a*, 10*b*, 10*c*, 10*d*, 10*e*, 10*f* are transverse cross-sections of the embodiment of FIGS. 8 and 9 along sections E—E, F—F, G—G, J—J, K—K, and L—L, respectively.
Figure 10B:
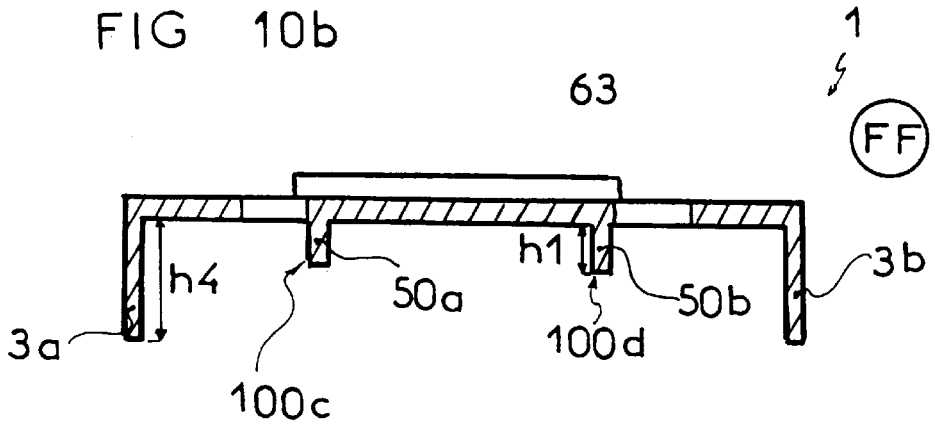
Figure 10C:
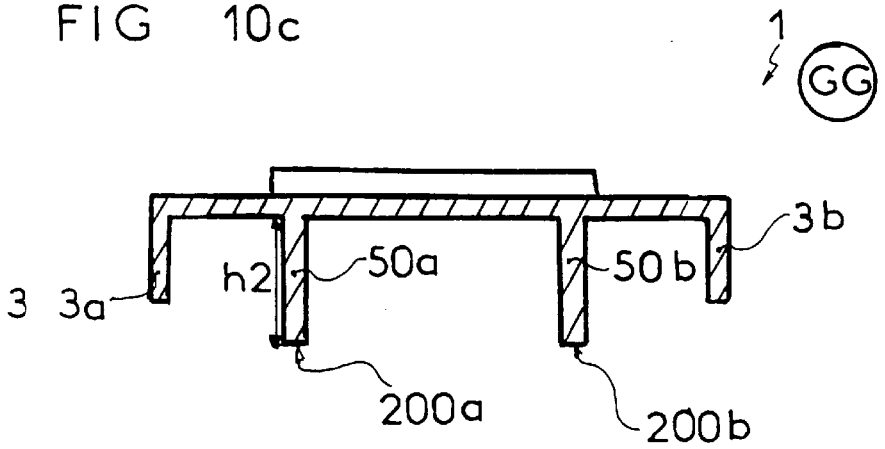
Figure 10D:
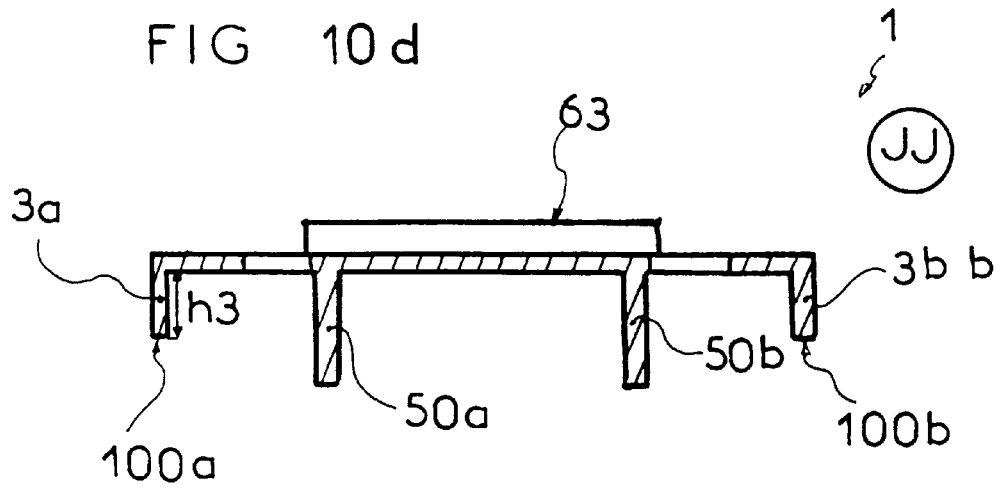
Figure 10E:
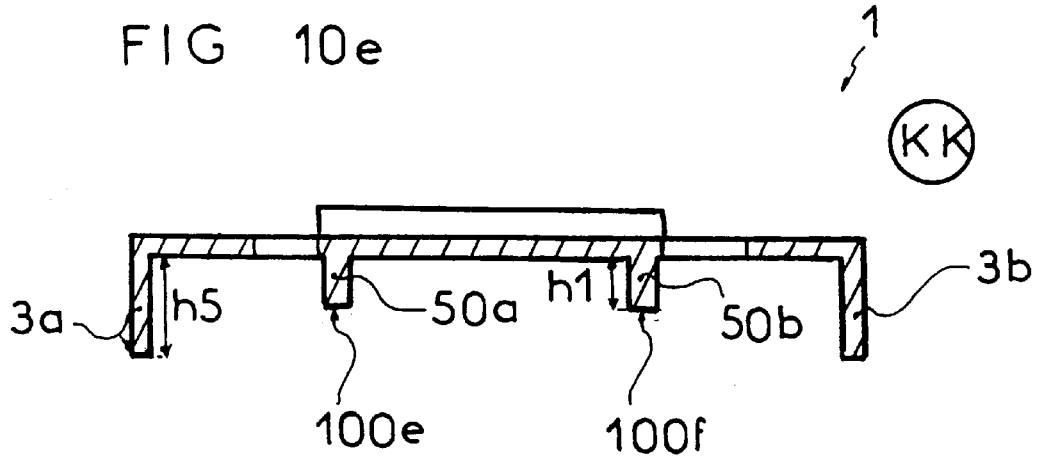

The longitudinal location of the height reductions 100*c*, 100*d*, 100*e*, 100*f* of the interior traction members 50*a*, 50*b* are offset relative to the central reductions in height 100*a*, 100*b* of the traction members that define the lateral edges 3*a*, 3*b* to form the frame 2. The central reductions in height 100*a*, 100*b* have a longitudinal position that corresponds preferably to a position of height enlargement 200*a*, 200*b* of the interior traction members. Note that the height enlargement is advantageously situated slightly toward the front AV of the snowshoe relative to the position of the central height reduction 100*a*, 100*b* which is illustrated in FIGS. 10*c* and 10*d*. The height enlargement is higher than the reduced height region, and is typically comparable in height to the full height regions of the traction member, but could be higher or lower.

According to a variation of this embodiment, the interior traction members can have other configurations which include not only the height reductions which are positioned in longitudinal correspondence or which are offset relative to the central height reductions of the lateral walls of the frame. Of course, the lateral traction members forming the frame can very well not have reductions in height and only the longitudinal interior traction members would be provided with this type of height reduction. Then again, the number of traction members and their number of height reductions could also be very different without departing from the intended scope of the present invention.

According to another preferred embodiment, the present invention is incorporated into a snowshoe of the type illustrated in French application No. 95 03088 of the applicant herein. It's lateral traction members present a transverse decrease in their width of separation in the central zone which is occupied by the boot of the user. The transverse reduction in space between the vertical edges corresponds advantageously to the reduction in height 100*a*, 100*b* of the lateral walls or lips 3*a*, 3*b* forming the peripheral frame 2. The height extensions 200*a*, 200*b* of the interior ridges are slightly displaced towards the front of the snowshoe. Of course, it is apparent that the number and the position of the aforementioned narrowing could be different without parting form the scope of the present invention.

According to a preferred embodiment of the snowshoe, the reductions in height 100*a*, 100*b*, 100*c*, 100*d*, 100*e*, 100*f* are obtained by making variations in the curvature of the lower edge (60) of the longitudinal traction members 3*a*, 3*b*, 50*a*, 50*b*. Note that the reductions in height 100*c*, 100*d*, 100*e*, 100*f* of the interior traction members are obtained thanks to a greater variation in the curvature of the lower edge relative to the curvature of the lateral walls, the slope the lower edge 60 being of the greater importance.

Note equally that according to the preferred embodiment of the present snowshoe, the longitudinal traction members 3*a*, 3*b*, 50*a*, 50*b* present a lower edge 60 which has the form of an extension of the portion in the central zone B, which members do not also have an edge portion of upright form.

Figure 10F:
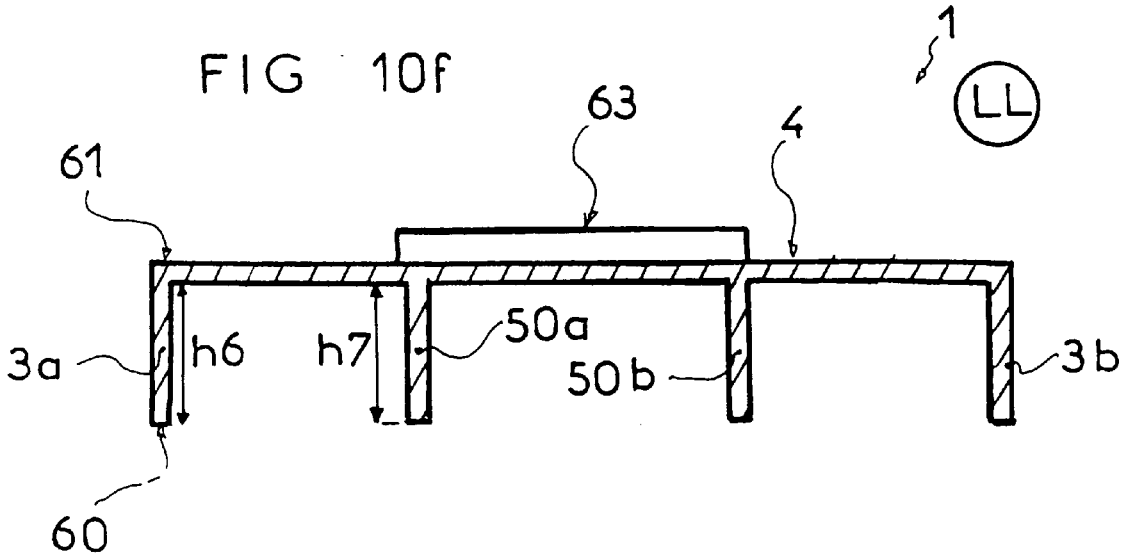

According to the preferred embodiment of the snowshoe and looking again to FIGS. 10*a*–10*f*, the height h1 of the reduced height ridge portions 100*c*, 100*d*, 100*e*, 100*f* of the interior traction members are identical and are preferably equal to half of height h2 of the height extensions 200*a*, 200*b*. Nevertheless, it could be above or below this without departing from the scope of the present invention. Along the central zone B, the height of these interior traction members is advantageously between 0.5 cm and 3.0 cm. Note that the height h3 of the reduced height portions 100*a*, 100*b* of the traction members 3*a*, 3*b* is higher than the height h1 the recessed regions 100*c*, 100*d*, 100*e*, 100*f* of the interior traction members. The height of the lateral traction members 3*a*, 3*b* are also in the range of 0.5 cm and 3.0 cm., along the length of the central zone B. In the embodiment illustrated in FIGS. 10*b* and 10*e*, the height of the lateral traction members h4 corresponding to the forward reduced height portions 100*c*, 100*d* of the interior members 50*a*, 50*b* and greater than the height h5 of the same lateral walls 3*a*, 3*b* measured level with the rear recessed wall portions 100*e*, 100*f*. It can be noted that the respective heights h6, h7 of the longitudinal traction members 3*a*, 3*b*, 50*a*, 50*b* lateral and interior is identical with the level of the ends before 7*a* and to the rear 7*c* of the central zone. The height is advantageously identical to the height h2 of the extended height 200*a*, 200*b* portions that are illustrated in FIGS. 10*a*, 10*d*, 10*f*.

Figure 11A:
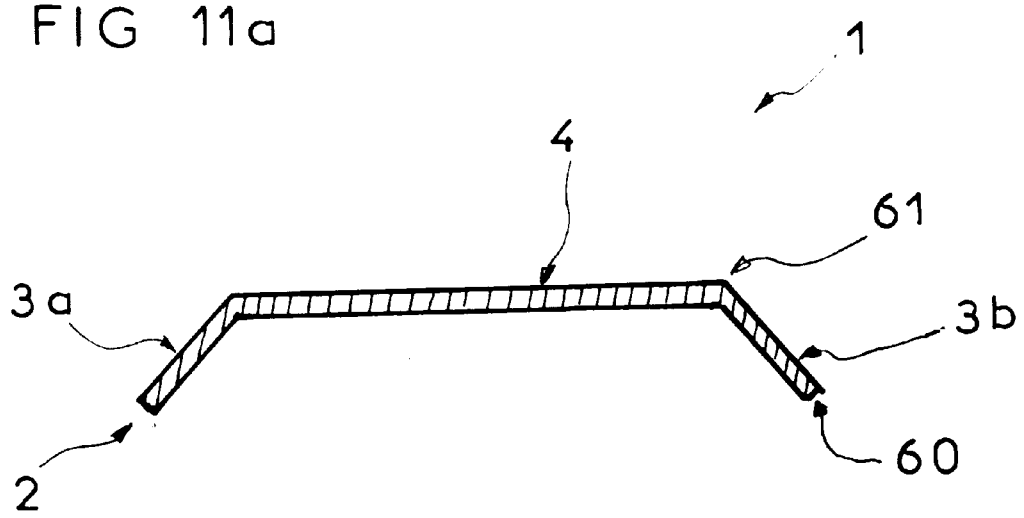
FIGS. 11*a*, 11*b*, and 11*c* are cross-sectional views analogous to FIGS. 3*a*, 3*b*, and 3*c* illustrating an alternated cross-section along sections A—A, B—B, and C—C of the snowshoe of FIG. 1.
Figure 11B:
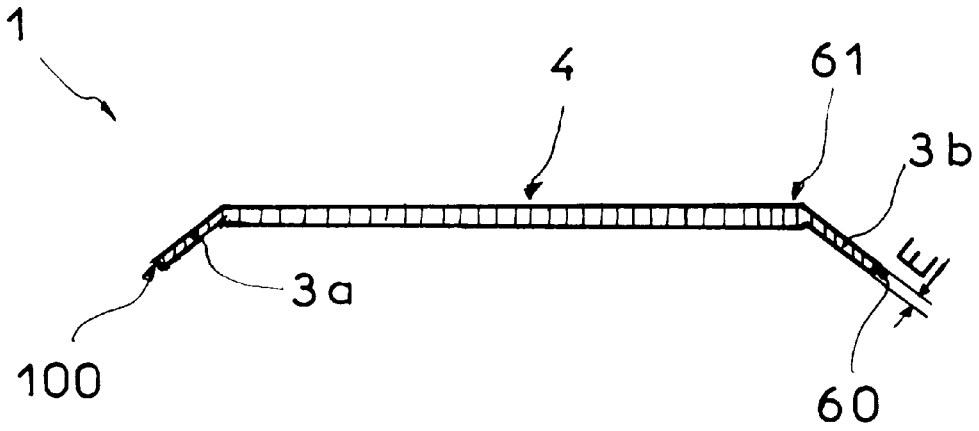
Figure 11C:
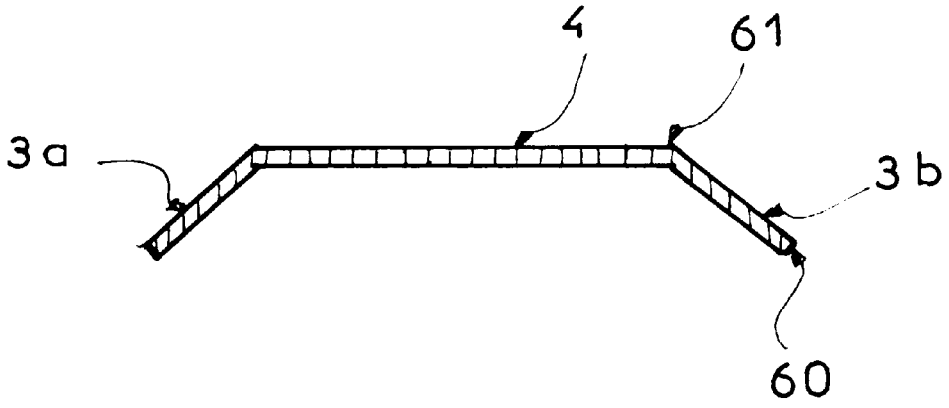

Note that in the preferred embodiment of the present snowshoe, the longitudinal traction members 3*a*, 3*b* , 50*a*, 50*b* are preferably vertical. Nonetheless, it can be otherwise as shown in the embodiment as illustrated in FIGS. 11*a*–11*c*. The lateral traction members 3*a*, 3*b* can be inclined relative to the vertical to extend, for example, downward and toward the exterior of the deck. These sloping members or flanges also have the reduced height regions of the present invention, as illustrated in FIG. 11*b*.

Furthermore, in this embodiment of the snowshoe, the thickness E of the longitudinal edge of the traction member is variable. The variation of the thickness E of the edge wall can be achieved by variation of the curvature of the internal face of the edge wall, of the external face, or of both faces. In this alternate embodiment, the thickness of the edge is variably longitudinally as shown in FIGS. 11*a*–11*c*. Nevertheless, the thickness of the edge can vary transversely along the height of these walls or flanges. As shown in FIG. 11*b*, the lateral traction edges 3*a*, 3*b* can have a reduction in thickness situated preferably at the same location as the reduction in height 100 of these traction members. Nonetheless, it could be otherwise and the members could, for example, have an extended height in this location with out departing from the scope of the present invention.

In the various illustrated embodiments, the snowshoe has longitudinal traction members or flanges whose profile in the transverse plane is rectilinear. Nonetheless, other profiles are contemplated including arcuate, slim, sharp, saw tooth, undulating, or others without departing from the scope of the present invention.

In the illustrated embodiments, the snowshoe is of an injection molded plastic type. However, other types of snowshoes can be equipped with the reductions in height in the central zone of the frame, such as snowshoes comprising a frame and a deck of web or lacings, for example, without departing form the present scope of the invention, the frame can be tubular in profile and can be constructed of aluminum or other materials such as plastic or composite materials.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A snowshoe comprising:

a peripheral frame:

a deck spanning an interior of a peripheral frame;

a binding for receiving a shoe of a user mounted on the deck;

a plurality of longitudinal traction members which extended generally downwward from a horizontal plane of the deck, the traction members having reduced height region adjacent the binding, which reduced height region is reduced in height relative to the height of the traction members before and behind the region adjacent the binding.

2. The snowshoe as set forth in claim 1, wherein the longitudinal traction members include a pair of lateral traction members which form lateral walls of the peripheral frame, said walls of the peripheral frame each having a reduced height region in the region adjacent the binding.

3. The snowshoe as set forth in claim 2, wherein the reduced height regions of the lateral walls of the peripheral frame are disposed symmetrically relative to a central longitudinal plane of the snowshoe.

4. The snowshoe as set forth claim 1, wherein at least one of the longitudinal traction members is disposed below the deck interior the peripheral frame, at least one interior traction member having a reduced height region in the region adjacent the binding.

5. The snowshoe as set forth in claim 4, wherein there are two traction members which are disposed symmetrically to either side of a central longitudinal plane, each traction member having two reduced height regions separated by a region of enlarged height relative to the reduced height region.

6. The snowshoe as set forth in claim 2, further including a pair of interior traction members depending downward from the deck, the interior traction members having reduced height regions in the region adjacent the binding.

7. The snowshoe as set forth in claim 6, wherein the reduced height regions of the interior traction members are aligned with the reduced height regions of the traction members depending from peripheral frame.

8. The snowshoe as set forth in claim 6, wherein the reduced height regions of the interior traction members depending downward from the deck are offset longitudinally relative to the reduced height regions of the traction members depending downward from the peripheral frame.

9. The snowshoe as set forth in claim 8, wherein the traction members which depend downward from the deck each have a pair of recessed height regions separated by a region of enlarged height, the regions of enlarged height of the traction members depending from the deck being aligned with the reduced height regions of the traction members depending downward from the peripheral frame.

10. The snowshoe as set forth in claim 8, wherein the interior traction members which depend downward from the deck each have a pair of recessed height regions separated by a region of enlarged height, the regions of enlarged height of the interior traction members depending from the deck being offset toward a front of the snowshoe relative to the reduced height regions of the traction members extending downward from the peripheral frame.

11. The snowshoe as set forth in claim 1, wherein the traction members have a lower edge, the lower edge of the traction members follows one of a linear sloping trajectory and a curving trajectory.

12. The snowshoe as set forth in claim 1, wherein a ratio of a minimum height of the traction members in the reduced height region relative to a maximum height of the traction members outside of the reduced height region is between 0.1 and 0.9.

13. The snowshoe as set forth in claim 1, wherein the traction members are thin wall like structures.

14. The snowshoe as set forth in claim 6, wherein the deck, lateral walls of the peripheral frame, and the interior traction members are one-piece of injection molded plastic.

* * * * *